US006782650B2

(12) United States Patent
McComas

(10) Patent No.: US 6,782,650 B2
(45) Date of Patent: Aug. 31, 2004

(54) NODULAR NICKEL BORON COATING

(76) Inventor: Edward McComas, 1286 SW. Evergreen LN, Palm City, FL (US) 34990

( * ) Notice: Subject to any disclaimer, the term of this patent is extended or adjusted under 35 U.S.C. 154(b) by 0 days.

(21) Appl. No.: 10/316,108

(22) Filed: Dec. 11, 2002

(65) Prior Publication Data

US 2004/0111947 A1 Jun. 17, 2004

(51) Int. Cl.[7] ..... F41A 21/22
(52) U.S. Cl. ..... 42/76.02; 106/1.22; 205/255
(58) Field of Search ..... 42/76.02; 106/1.22; 205/110, 255

(56) References Cited

U.S. PATENT DOCUMENTS 4,833,041 A * 5/1989 McComas ..... 428/610
6,146,735 A * 11/2000 Viggiano ..... 428/64.2
6,308,448 B1 * 10/2001 Kapusta et al. ..... 42/69.02
6,319,308 B1 * 11/2001 McComas ..... 106/1.22
6,347,474 B1 * 2/2002 Wolff, Jr. ..... 42/69.01
6,372,118 B1 * 4/2002 Hui ..... 205/259
2002/0079133 A1 * 6/2002 Yamamoto et al. ..... 174/256

* cited by examiner

*Primary Examiner*—Michael J. Carone
*Assistant Examiner*—Gabriel Sukman
(74) *Attorney, Agent, or Firm*—Sam Silverberg

(57) ABSTRACT

The invention is directed to a nodular nickel boron coating having lubricating properties. Nodular and columnar boron coatings made by the above methods disclosed in the above patents have a low coefficient of friction. The above process results in a columnar structure with nodules in the surface layer. Nodules can be produced in other nickel coatings by blasting the surface with hard particles to form the nodules. Using blasting to form the nodules produces an inferior coating in contrast to the electroless nickel boron coatings having a columnar structure.

15 Claims, No Drawings

NODULAR NICKEL BORON COATING

FIELD OF THE INVENTION

This invention relates to nodular nickel boron coatings on surfaces that requires a low coefficient of friction as well as a superior wear resistance. These coatings can be used as an improved substitute for wet lubricants. A lubricant can be incorporated in the nickel boron coating or can be coated onto the nickel boron coating. The final coatings provide improved wear resistance, corrosion resistance and lubricity.

DESCRIPTION OF RELATED ART

Nickel boron coatings have been described in U.S. Pat. Nos. 6,319,308; 6,066,400 and 5,019,163. These references are incorporated by reference. Usually an electroless coating process as shown in these patents is used to make these coatings. These coatings have a nodular and columnar structure. U.S. Pat. No. 6,319,308 teaches that a lubricant particle can be co-deposited with the nickel boron coating.

The prior art has used wet lubricants to reduce the coefficient of friction and to reduce corrosion in firms. Usually firearms need to be cleaned and greased on a regular basis after firing. If not regularly greased, the firearm might jam or misfire.

The use of wet lubricants presents a problem for soldiers in the military. Wet lubricants attract grit or sand causing the firearms to jam requiring increased maintenance.

Phosphate reduced electroless coatings have been used on metal substrates such as firearms, to enhance corrosion resistance. These coatings do not possess the wear resistance and lubricity of the nodular nickel boron coatings.

An objective of the invention is to provide dry nodular nickel boron coating having improved lubricity. Another objective of this invention is to provide a substitute for wet lubricants, especially for firearms. Firearms as used in this application cover all types of weapons that use gun powder including rifles cannons and artillery. One objective being to increase the interval needed for reapplying the lubricant to the firearm parts.

SUMMARY OF THE INVENTION

The invention is directed to a nodular nickel boron coating having lubricating properties. Nodular and columnar boron coatings made by the above methods disclosed in the above patents have a low coefficient of friction. The above process results in a columnar structure with nodules in the surface layer. Nodules can be produced in other nickel coatings by blasting the surface with hard particles to form the nodules. Using blasting to form the nodules produces an inferior coating in contrast to the electroless nickel boron coatings having a columnar structure.

A lubricant can be introduced to the nickel boron coating by co-depositing a lubricant particle with the nickel boron or after treating the nickel boron coating with a dry lubricant. A variety of techniques exist for the treatment such as blasting the lubricant into the coating with high pressure or burnishing the dry lubricant into the nickel boron surface with a tumbling bowl or by rubbing the dry particle into the nickel boron surface. Examples of dry lubricants are tungsten disulfide or moly disulfide or PTFE (Teflon, trademark)).

DETAILED DESCRIPTION OF THE INVENTION

The coating composition is useful for substrates that need lubricity as well as wear resistance such as mating surfaces.

The firearm industry has a need for these coating compositions. These coatings would allow firearms to be used with a longer maintenance schedule that is required when using the recommended conventional wet lubricants. The maintenance schedule established by firearm manufactures usually instruct users that the guns have be cleaned and then reassembled with fresh grease and oil after every 1000 rounds to prevent corrosion and lock up of the firing mechanisms.

By applying the nodular nickel coating parts to the surfaces of mating components the wear life of the components can be extended beyond the wear life provided by wet lubricants. Firearm components are one example of mating surfaces that would benefit from nodular nickel coatings.

Another problem with wet lubricants is that dusts and grime and sand easily attach. This increases the need for cleaning and re-greasing in unfriendly environments.

Also the continuous firing of rounds wears out the barrel of guns and rifles. These coatings extend the wear of the barrels and acts as sacrificial coating. By acting as a sacrificial coating the barrels can be re-plated allowing the barrel to be reused.

The following experiments were done to show the effectiveness of the these coatings:

Weapon preparation for plating:

1) Guns are known to have close fit tolerances and a nickel boron coating would add additional dimension to all surfaces, so careful measurements were recorded of all critical surfaces before the factory coatings were removed.
2) Next we stripped the various factory coatings, hard anodize on the aluminum surfaces, manganese phosphate from the steel parts and hard chrome from inside of the gun barrel.
3) Measurements were retaken to establish the mass removed by removing the various factory coatings.
4) We concluded an average nickel boron thickness of 0.0005–0.001 inches could be applied without disrupting function.
5) The aluminum components were processed as follows:
   - A. The factory anodized surfaces were stripped by submerging parts in a zincate solution until the surfaces were free of aluminum oxide.
   - B. Small threaded holes were plugged to prevent plating from depositing.
   - C. The parts were then placed in a non etch aluminum soak cleaning solution for 2–3 minutes.
   - D. The parts were then placed in a chemical etch solution for 40 seconds
   - E. The parts were then placed in a standard zincate solution for 15 seconds
   - F. The parts were then placed in a nickel strike solution to provide a protective layer from the highly alkaline nickel boron bath.
   - G. The parts were then placed in the nickel boron solution as follows:
     1. A solution of water, 0.25 pounds of nickel salts, 1 pound of ethylenediamine, ⅓ pound of ammonium hydroxide ⅓ pound of sodium hydroxide topped-off to one gallon.
     2. The above solution was heated to a temperature of 1908 F+/−5*F.
     3. To the solution above (the bath) 10 mls of a reducing agent was added. The reducing agent was made as follows: 1 pound of sodium borohydride was added to ½ gallon of water and to that, 2 pounds of sodium borohydride was added, topped-off to one gallon.

4. To the bath solution above, 10 mls of the stabilizer solution was added. The stabilizer was made as follows; 10 grams of lead tungstate was added to ¾ gallon of water. To that, 50 grams of sodium hydroxide was added. To that, 150 mls of ethylenediamine, to that, 50 mls of ethylenediamine tetraacetate was added and topped-off with water to equal one gallon. 50 grams of surfactant was added and mixed well.
5. The gun parts were left in the plating solution for 1½ hours and received 0.0006 inch of nickel boron coating.

6) The steel components were plated as follows:

A. The factory magnesium phosphate coating was removed by placing the parts in a solution of water and 16 oz per gallon of sodium hydroxide at a temperature of 150 *F. for 1 hour.

B. The parts were then placed in a detergent type soak cleaning solution for 2–3 minutes at 160 *F.

C. The parts were then placed in an acid solution for 1–2 minutes for surface activation D. The parts were then placed in the same nickel boron plating solution for 1½ hours to receive approximately 0.0006 inch of nickel boron coating.

E. The nickel boron was made and used as follows:

1. A solution of water, 0.25 pounds of nickel salts, 1 pound of ethylenediamine, ⅓ pound of ammonium hydroxide ⅓ pound of sodium hydroxide topped-off to one gallon.
2. The above solution was heated to a temperature of 1908 F+/−5*F.
3. To the solution above (the bath) 10 mls of a reducing agent was added. The reducing agent was made as follows: 1 pound of sodium borohydride was added to ½ gallon of water and to that, 2 pounds of sodium borohydride was added, topped-off to one gallon.
4. To the bath solution above, 10 mls of the stabilizer solution was added. The stabilizer was made as follows; 10 grams of lead tungstate was added to ¾ gallon of water. To that, 50 grams of sodium hydroxide was added. To that, 150 mls of ethylenediamine, to that, 50 mls of ethylenediamine tetraacetate was added and topped-off with water to equal one gallon. 50 grams of surfactant was added and mixed well.
5. The gun parts were left in the plating solution for 1½ hours and received 0.0006 inch of nickel boron coating.
6. To increase hardness, the steel parts were heat-treated at 700*F. for 90 minutes, by doing so, hardness increased from 980 knoop to 1410 Knoop.

7. The gun barrels, steel were processed along with the other steel parts above but the chrome plating was first removed by using an inhibited hydrochloric acid at 40% with water. The barrel was submerged in the acid for approximately 2 hours until all of the chrome deposit was removed. Plating was as follows:

1. A solution of water, 0.25 pounds of nickel salts, 1 pound of ethylenediamine, ⅓ pound of ammonium hydroxide ⅓ pound of sodium hydroxide topped-off to one gallon.
2. The above solution was heated to a temperature of 1908 F+/−5*F.
3. To the solution above (the bath) 10 mls of a reducing agent was added. The reducing agent was made as follows: 1 pound of sodium borohydride was added to ½ gallon of water and to that, 2 pounds of sodium borohydride was added, topped-off to one gallon.
4. To the bath solution above, 10 mls of the stabilizer solution was added. The stabilizer was made as follows; 10 grams of lead tungstate was added to ¾ gallon of water. To that, 50 grams of sodium hydroxide was added. To that, 150 mls of ethylenediamine, to that, 50 mls of ethylenediamine tetraacetate was added and topped-off with water to equal one gallon. 50 grams of surfactant was added and mixed well.
5. The gun parts were left in the plating solution for 1½ hours and received 0.0006 inch of nickel boron coating.
6. To increase hardness, the steel parts were heat-treated at 700*F. for 90 minutes, by doing so, the hardness increased from 980 Knoop to 1410 Knoop based on a 25 gram load.

Test firing schedules; At times, an inexpensive ammunition was intentionally used because they are known to be damaging to weapon surface finishes by means of corrosive gun powder residue. If this residue isn't thoroughly removed from all surfaces, the residual material becomes acidic and attacks the base metal of the weapon. An objective of this invention is protecting a gun surface with nickel boron from this chemical attack is.

Two test guns were reassembled but one was first burnished with a molly disulfide compound as a dry film lubricant on top of the nickel boron coating. The gun without moly lubrication was at first a little "sticky" and rough in operation but eventually operated as well as the weapon with the dry film lubrication. Extra polishing was required in the breach area of the barrel to prevent the ammunition from hanging-up as it tried to discharge the casing in the non lubricated gun.

The first test firing cycle was as follows, 470 rounds of Winchester ammo was fired in both semi and full automatic mode without incident. The guns were left as fired with no cleaning as is normally done and required by the manufacture. The same day, but 8 hours later, an additional 500 rounds of Wolf Brand ammunition were fired as above without incident or cleaning before, during or after firing. 24 hours later, additional 1200 rounds were fired and again without incident and again the weapons were stored without cleaning. 2 days later, the weapons 500 rounds were fired. The following week, the weapons were again fired, 2000 rounds total with 3 miss-fires that were related to a poor quality magazine, completely unrelated to the function of the gun and it's coated parts.

Both weapons have fired a total of 4670 rounds total. The only miss fires occurred in the initial start-up of the gun without the moly disulfide dry lubrication. Since then, this gun has been incident free. The dry film lubricated gun was had 3 misfires that occurred around 2100 round count due to the poor magazine.

These examples show that the maintenance schedule required by wet lubricants can be greatly extended using these coatings.

The preferred surface roughness for these coatings on firearm components should be about 20 RMS. The coating after an electroless nickel boron deposition usually has surface roughness of about 40 RMS. A lower RMS is usually needed to reduce the wear between mating surfaces and to prevent unwanted particles like sand from being trapped between the nodules. The surface roughness can be reduced using conventional polishing techniques.

This nodular coating forms a self-lubricating firearm. A self-lubricating firearm means a firearm having at least one component with a nodular nickel coating. The properties of the coating include satisfying the need for a wet lubricant, extending the cleaning interval and extending the life of the barrel.

The boron content of the coating should be over 2.5% and not exceeding 6%. As the boron content increase the hardness increases. The preferred range is 4–4.5% by weight.

Applying a mixture of tungsten disulfide and moly disulfide 80:20% or 20:80% by weight or volume to a nodular nickel coating enhance the nickel boron coating. About a 50:50 mixture is preferred. These ingredients have uniquely different structure and properties that compliment each other. The mixture can be applied as follows.

1) Burnishing it in the nickel coating by rubbing;
2) Thinning it with a solvent and painting on the nickel surface.
3) Blasting it into the surface mixed with glass bead or by blasting it into the surface with high pressure gas, like nitrogen, at 250–1000 PSI without glass beads.

What is claimed is:

1. A self lubricating firearm having at least one component coated with nodular nickel coating wherein the nodular nickel coating is an electroless deposited nickel boron coating.

2. A firearm according to claim 1 wherein lead tungstate was used as a stabilizer during electroless deposition of the nickel boron.

3. A firearm according to claim 1 wherein the nodular nickel coating is polished.

4. A firearm according to claim 1 wherein the component is a gun barrel.

5. A firearm according to claim 1 wherein the nickel coating has a dry lubricant overcoat.

6. A firearm according to claim 5 wherein the dry lubricant is selected from the group consisting of tungsten disulfide and molybdenum disulfide.

7. A firearm according to claim 1 wherein the component is a barrel.

8. A firearm according to claim 1 wherein the coating satisfies the need for a wet lubricant.

9. A process for making a self lubricating firearm comprising applying a nodular nickel coating to a firearm component wherein the nodular nickel coating is applied by electroless depositing nickel boron.

10. A process according to claim 9 wherein lead tungstate is used as a stabilizer during the electroless deposition of the nickel boron.

11. A process according to claim 9 wherein a dry lubricant is applied over the nickel boron coating.

12. A process according to claim 9 wherein said coating satisfies the need for a wet lubricant.

13. A process according to claim 9 wherein said component is free of a wet lubricant.

14. A firearm according to claim 8 wherein said coated surface is free of a wet lubricant.

15. A process according to claim 9 wherein said component is a barrel.

* * * * *